US007841917B2

(12) United States Patent
Pritchard

(10) Patent No.: US 7,841,917 B2
(45) Date of Patent: Nov. 30, 2010

(54) FLOATATION DEVICE

(75) Inventor: Philip Anthony Pritchard, Nottingham (GB)

(73) Assignee: Deep Sea Recovery Ltd, Nottingham (GB)

( * ) Notice: Subject to any disclaimer, the term of this patent is extended or adjusted under 35 U.S.C. 154(b) by 188 days.

(21) Appl. No.: 12/194,702

(22) Filed: Aug. 20, 2008

(65) Prior Publication Data

US 2010/0043692 A1 Feb. 25, 2010

(51) Int. Cl.
*B63B 22/18* (2006.01)

(52) U.S. Cl. ..... 441/21; 441/29; 441/32

(58) Field of Classification Search ..... 441/21, 441/29, 32

See application file for complete search history.

(56) References Cited

U.S. PATENT DOCUMENTS

| | | | | |
|---|---|---|---|---|
| 2,371,404 | A * | 3/1945 | Mumford | 441/32 |
| 3,256,538 | A | 6/1966 | Waller et al. | |
| 3,503,443 | A * | 3/1970 | Trageser et al. | 166/344 |
| 4,266,500 | A * | 5/1981 | Jurca | 114/333 |
| 6,269,761 | B1 * | 8/2001 | Abraham et al. | 114/123 |
| 6,537,118 | B2 * | 3/2003 | McAlpine | 441/7 |
| 6,772,705 | B2 | 8/2004 | Leonard et al. | |

FOREIGN PATENT DOCUMENTS

| | | |
|---|---|---|
| GB | 2 354 487 | 3/2001 |
| WO | WO 00/29285 | 5/2000 |
| WO | WO 02/072416 | 9/2002 |

OTHER PUBLICATIONS

UK Search Report dated Apr. 17, 2008, issued in connection with GB 0805208.6.

UK Search Report dated Jun. 20, 2007, issued in connection with GB 0704602.2.

* cited by examiner

*Primary Examiner*—Stephen Avila
(74) *Attorney, Agent, or Firm*—Nixon & Vanderhye P.C.

(57) ABSTRACT

A floatation device is disclosed that comprises a container 10 containing a liquefied gas, a gas chamber (60, FIG. 2) and a remotely operable device 29. The remotely operable device is switchable between a closed state in which fluid communication between the container and the gas chamber is prevented, and an open state in which fluid communication between the container and the gas chamber is enabled and vaporization of the liquefied gas charges the gas chamber with gas. The liquefied gas may be liquid nitrogen and the container may be heat insulated with an insulating vacuum cavity. A buoyancy unit (40, FIG. 2) which comprises a rigid enclosure (42, FIG. 2) defining an interior volume and a flexible diaphragm (55, FIG. 2) that partitions the interior volume into first and second chambers is also disclosed.

15 Claims, 14 Drawing Sheets

FLOATATION DEVICE

This invention relates to floatation devices and in particular to floatation devices for raising and lowering items to and from the seabed.

Sea-going vessels such as ships and submarines often carry valuable cargo, and are generally very valuable themselves. If such vessels are damaged whilst at sea and subsequently sink to the seabed, it is highly desirable to be able to recover the cargo, or even the vessel itself. Recovery of items such as these requires a method of raising the items to the surface from the seabed. Other instances that require items to be raised and lowered to and from the seabed is when mining on the seabed, and when constructing or decommissioning oil and gas platforms, and ancillaries.

One method of recovering items from the seabed involves the use of floatation devices secured to the item. These floatation devices typically comprise a compressed gas canister contained within an inflatable body. In use, a large number of these floatation devices are secured to the item to be raised, and gas is then remotely released from the gas canisters thereby inflating the inflatable body. The upward buoyancy force exerted by the sea on the inflated floatation devices acts to raise the item to the surface.

Conventional floatation devices are only effective up to a certain depth. At greater depths, the pressure exerted by the surrounding water on the inflatable body is too great for the inflatable body to inflate sufficiently to raise the item from the seabed.

There has now been devised an improved floatation device which overcomes or substantially mitigates the above-mentioned and/or other disadvantages associated with the prior art.

According to a first aspect of the invention, there is provided a floatation device comprising a container containing a liquefied gas, a gas chamber and a remotely operable device, the remotely operable device being switchable between a closed state in which fluid communication between the container and the gas chamber is prevented, and an open state in which fluid communication between the container and the gas chamber is enabled and vaporisation of the liquefied gas, in use, charges the gas chamber with gas.

The device according to the invention is advantageous principally because the liquid gas is able to vaporise and charge the gas chamber with gas even when the surrounding pressure is great. The device according to the invention is therefore effective at greater depths than conventional devices that use compressed gas canisters.

The liquefied gas may be any suitable substance. Most preferably, the liquefied gas is liquid nitrogen. Liquid nitrogen is both relatively cheap and readily available.

The device may be formed in any materials which have the strength to withstand the pressures that the device will encounter during use. Suitable materials for the device include metals, such as austenitic steel and stainless steel, plastics materials, carbon-fibre materials, and glass-fibre materials.

The container is preferably heat-insulated. This heat-insulation may be achieved by any conventional means that is suitable for incorporation in a floatation device.

For instance, the container may be formed in, lined, or surrounded by a material having good heat-insulating properties. Most preferably, however, the container includes an insulating vacuum cavity. In addition, the container may incorporate a cooling system such as those conventionally used with liquefied gases.

The floatation device may include means for heating the liquefied gas within the container. Alternatively, the floatation device may include means for aiding heat conduction from the surroundings to the liquefied gas within the container. For example, the floatation device may include one or more remotely operable devices that conduct heat across insulating material, or an insulating vacuum cavity, when activated. However, the provision of such devices is entirely optional.

The container preferably has an opening or fluid conduit that leads into the gas chamber. The container preferably includes a fluid conduit that connects the interiors of the container and the gas chamber. The fluid conduit may be adapted so as to allow liquid nitrogen flowing through the fluid conduit to be heated.

Preferably, the fluid conduit has the form of a pipe with a small cross-section and large length relative to the corresponding dimensions of the container. Most preferably, the fluid conduit is a pipe that is coiled about the external surface of the container. Where the container includes an insulating vacuum cavity, the fluid conduit is preferably situated within this cavity, and is most preferably situated adjacent to an inner surface of an outer wall of the container.

The gas chamber may comprise a containing wall that substantially surrounds the gas within the chamber. Alternatively, the gas chamber may have an open lower end, with the gas being retained within the gas chamber by its buoyancy within the water. In any case, the gas chamber preferably includes at least one pressure release vent that vents the vaporised gas, as necessary, during use.

The gas chamber may be integrally formed with the container, but is most preferably formed as a separate component which is secured to the container during use.

The gas chamber may be rigid or flexible in form. Where the gas chamber is flexible, the flexible gas chamber is preferably formed in a conventional coated fabric material and is preferably fixed to the periphery of the opening or the fluid conduit of the container. The flexible gas chamber is preferably deflated before use and is inflated by the vaporised gas in use. However, the gas chamber is preferably at least partially rigid in form. In particular, according to a further aspect of the invention, there is provided a buoyancy unit comprising a rigid enclosure defining an interior volume and a flexible diaphragm that partitions the interior volume into first and second chambers, the first chamber being adapted to contain a gas and having an inlet for connection to a gas supply, and the second chamber having a fluid outlet, wherein the diaphragm is movable on charging of the first chamber with gas so as to urge fluid within the second chamber out of the buoyancy unit through the fluid outlet.

The buoyancy unit according to the invention is advantageous principally because it functions in an analogous manner to a gas chamber formed by an entirely flexible enclosure, but is less likely to be damaged in harsh deep sea environments because the flexible diaphragm is protected within the rigid enclosure. In addition, the buoyancy of the buoyancy unit may be easily, and accurately, controlled by altering the ratio of the volume of gas within the buoyancy unit to the volume of fluid within the buoyancy unit.

The floatation device according to the invention preferably comprises a gas chamber that forms part of such a buoyancy unit.

By "rigid" enclosure is meant that the enclosure maintains its shape during normal use. The first chamber preferably includes at least one pressure release vent that vents the gas, as necessary, during use, and the fluid outlet of the second chamber is preferably a simple aperture. The first chamber may also include a remotely operable vent for controlling the buoyancy of the buoyancy unit.

Preferably, the diaphragm is fixed at its periphery to the interior surface of the rigid enclosure along a line that is confined to a single plane, and the diaphragm is enlarged relative to the corresponding cross-sectional area of the rigid enclosure so that the diaphragm may be displaced so as to lie alongside an interior surface of the rigid enclosure. Most preferably, the diaphragm is fixed at its periphery to the interior surface of the rigid enclosure along a line that is confined to a single plane that bisects the interior volume.

The remotely operable device may be a single valve, or a plurality of valves, which may be located within the opening or fluid conduit of the container and have an open state that allows fluid communication between the container and the gas chamber. Alternatively, the remotely operable device may be a device that either physically prevents or allows inflation of the flexible gas chamber, or movement of the flexible diaphragm, by the vaporised gas.

Furthermore, according to the present invention there is provided buoyancy unit comprising a rigid enclosure defining an interior volume and a flexible diaphragm that partitions the interior volume into first and second chambers, the first chamber being adapted to contain a gas and having an inlet for connection to a gas supply, and the second chamber having a fluid outlet, wherein the diaphragm is movable on charging of the first chamber with gas so as to urge fluid within the second chamber out of the buoyancy unit through the fluid outlet.

The first chamber may include at least one pressure release vent that vents the gas, as necessary, during use. The fluid outlet of the second chamber may be a simple aperture. The first chamber may include a remotely operable vent for controlling the buoyancy of the buoyancy unit.

The diaphragm may be fixed at its periphery to the interior surface of the rigid enclosure along a line that is confined to a single plane, and the diaphragm may be enlarged relative to the corresponding cross-sectional area of the rigid enclosure so that the diaphragm may be displaced so as to lie alongside an interior surface of the rigid enclosure.

The diaphragm may be fixed at its periphery to the interior surface of the rigid enclosure along a line that is confined to a single plane that bisects the interior volume.

According to a further aspect of the invention, there is provided a method of raising an item from the seabed, or lowering an item to the seabed, which method comprises the steps of: (a) attaching a floatation device as described above to the item, and (b) switching the remotely operable device from its closed state to its open state, such that the gas chamber is charged with gas resulting from vaporisation of the liquefied gas.

Where an item is being raised from the seabed, the floatation device is attached to the item whilst the item is on the seabed. In this case, the floatation device may be lowered down to the seabed, or allowed to descend under the influence of gravity. The step of attaching the floatation device to the item on the seabed is preferably performed by a remotely operable means, such as a robot. The switching of the remotely operable device from its closed state to its open state is preferably achieved by a user at the surface of the sea transmitting signals, for example electromagnetic radiation signals, to the device.

The invention will now be described in greater detail, by way of illustration only, with reference to the accompanying drawings, in which FIG. 1 is a schematic view of a container forming part of a first embodiment of a floatation device according to the invention;

Figure 1:
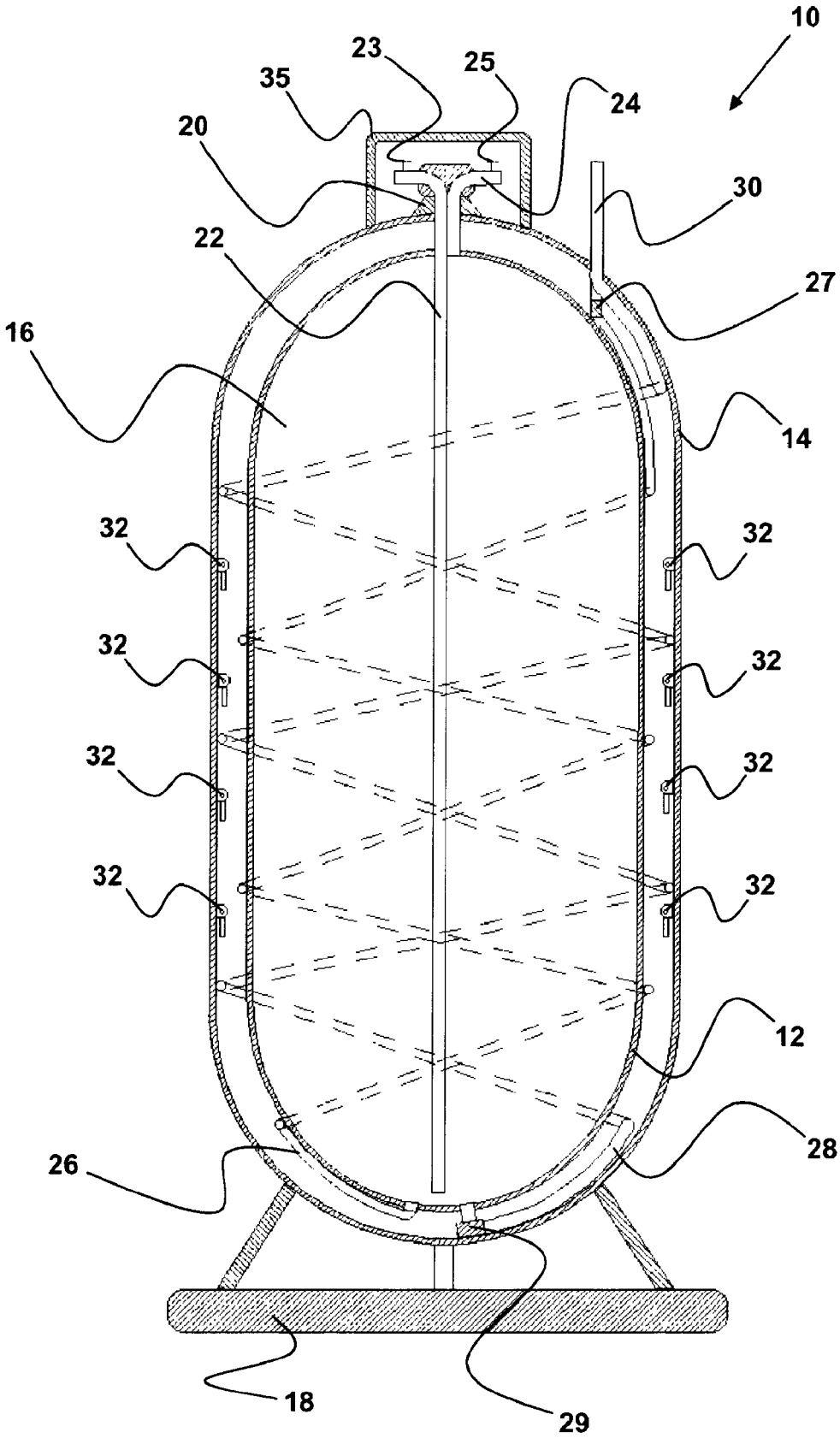

A first embodiment of a floatation device according to the invention is shown in FIGS. 1 to 5. The first embodiment comprises a container 10, which is shown in FIG. 1, and a lift unit 40, which is shown in FIGS. 2 to 5.

Referring firstly to FIG. 1, the container 10 comprises an inner wall 12 defining a chamber 16 suitable for containing liquid nitrogen, an outer wall 14 wholly encompassing the inner wall 12, and a stand 18. The chamber 16 is generally cylindrical in shape but has end portions that are hemispherical in shape. The stand 18 comprises a base that rests upon the ground, and four inclined struts that extend from the upper surface of the base and are fixed to the external surface of the outer wall 14 at one end of the chamber 16, thereby supporting the chamber 16 in a vertical orientation.

The inner wall 12 is formed of austenitic steel, and the outer wall is formed of glass-fibre reinforced plastics material (GRP). The outer wall 14 is separated from the inner wall 12 and a hermetically sealed cavity is formed between these walls 12, 14. During manufacture, a vacuum is formed within this cavity between the inner and outer walls 12, 14, thereby providing heat-insulation for the chamber 16.

At the upper end of the chamber 16 (as viewed in FIG. 1), an inlet pipe 22 and a vent pipe 24 extend through the inner and outer walls 12, 14 of the container 10.

The inlet pipe 22 extends along the length of the chamber 16 to a position near to its lower end. The vent pipe 24 terminates at the interior surface of the inner wall 12 at the upper end of the chamber 16.

A mount 20 is formed on the upper external surface of the outer wall 14 with the inlet and vent pipes 22,24 extending through the mount 20, and branching horizontally away from one another, such that the pipes 22,24 project from the mount 20 in opposing horizontal (as viewed in FIG. 1) directions. The end portions of the inlet and vent pipes 22,24 that project from the mount 20 each include a valve 23,25 for controlling flow along the pipes 22,24. The mount 20, and the end portions of the inlet and vent pipes 22,24 that project from the mount 20, are enclosed in use within a hermetically sealed, and pressure-resistant housing 35 that is releasably fastened to the upper external surface of the outer wall 14.

At the lower end of the chamber 16, the inner wall 12 includes a pair of circular apertures. A cooling pipe 26 extends from one of the circular apertures, and coils around the outer surface of the inner wall 12 towards the upper end of the container 10. Near to the upper end of the container 10, the cooling pipe 26 joins an outlet pipe 30 that extends upwardly (as viewed in FIG. 1) through the outer wall 14 and communicates with the lift unit 40, as described below. The cooling pipe 26 includes a pressure-release valve 27 at its upper end that allows fluid flow from the cooling pipe 26 into the outlet pipe 30, and hence the lift unit 40, when the pressure within the cooling pipe 26 is approximately 100 millibars higher than the pressure within the lift unit 40. The cooling pipe 26 and outlet pipe 30 are formed predominantly of metal. However, the portion of the outlet pipe 30 that extends across the cavity between the valve 27 at the outer surface of the inner wall 12 and the inner surface of the outer wall 14 is formed of a plastics material having a low thermal conductivity coefficient.

A heating pipe 28 extends from the other circular aperture at the lower end of the chamber 16, and coils around the chamber 16 along the inner surface of the outer wall 14 towards the upper end of the container 10. Near to the upper end of the container 10, the heating pipe 28 also joins the outlet pipe 30 that extends upwardly through the outer wall 14. The heating pipe 28 includes a valve 29 at its lower end, adjacent to the inner surface of the outer wall 14, that controls fluid flow into the heating pipe 28, and hence into the outlet pipe 30 and the lift unit 40.

The heating pipe 28 is formed predominantly of metal. However, the portion of the heating pipe 28 that extends across the cavity between the circular aperture of the inner wall 12 and the valve 29 at the inner surface of the outer wall 14 is formed of a plastics material having a low thermal conductivity coefficient.

Finally, a number of remotely operable heat conductors 32 are fastened to the inner surface of the outer wall 14 around the central cylindrical portion of the chamber 16. The heat conductors 32 each comprise a copper rod which is disposed alongside the inner surface of the outer wall 14 when deactivated, and extends outwardly from the inner surface of the outer wall 14 into contact with the outer surface of the inner wall 12 when activated. Hence, when activated, the heat conductors 32 conduct heat from the outer wall 14, through the copper rods, and into the chamber 16 through the inner wall 12.

Turning now also to FIGS. 2 to 5, the lift unit 40 comprises a rigid shell 42 formed of glass-fibre reinforced plastics material (GRP). The interior volume of the shell 42 has a similar shape to the chamber 16 of the container 10 in that it comprises a central cylindrical portion and hemispherical end portions. This interior volume of the shell 42 is partitioned by a diaphragm 55 into a sea water chamber 50 and a gas chamber 60. The diaphragm 55 is fixed at its periphery to the interior surface of the shell 42 in a plane that bisects the interior volume of the shell 42 along its longitudinal axis.

The diaphragm 55 is enlarged relative to the corresponding cross-sectional area of the shell 42 so that the diaphragm 55 may be displaced so as to lie alongside an interior surface of the shell 42. In this way, displacement of the diaphragm 55 varies the relative sizes of the sea water chamber 50 and the gas chamber 60.

At the lower end of the lift unit 40 (as viewed in FIGS. 2 to 5), a gas inlet pipe 62 extends through the wall of the shell 42 and into the gas chamber 60. The gas inlet pipe 62 of the lift unit 40 is connected by a connecting pipe (not shown in the Figures) to the outlet pipe 30 of the container 10. In addition, the lift unit 40 is firmly secured to the container 10, in use, by high-strength connecting cables (not shown in the Figures), or other suitable means, that may be clamped, bolted or welded to the container 10 and the lift unit 40.

The shell 42 also comprises a set of vents 64 having remotely operable valves that either allow or prevent the exit of gas from the gas chamber 60, and a set of apertures 52 that allow the passage of sea water into, and out of, the sea water chamber 50. The vents 64 also have a pressure-release mechanism whereby gas is allowed to exit the gas chamber 60 when the pressure within the gas chamber 60 exceeds the pressure of the surrounding sea water by a predetermined threshold value, such as 100 millibars. Finally, the external surface of the shell 42 is provided with suitable means 44 for attaching the lift unit to a load to be lifted.

In use, the chamber 16 of the container 10 is firstly charged with liquid nitrogen.

This process is usually carried out while the floatation device is aboard a ship or the like. Initially, the housing 35 is unfastened from the outer wall 14, the inlet valve 23 and vent valve 25 are put into an open state that allows fluid flow along the inlet and vent pipes 22,24, and the outlet valve 29 is put into a closed state that prevents fluid flow from the chamber 16 into the heating pipe 28. A supply of liquid nitrogen is then connected to the inlet pipe 22 so that liquid nitrogen enters the chamber 16 at its lower end. Since the interior of the chamber 16 is at a relatively higher temperature than the liquid nitrogen, nitrogen gas will be produced which will pass through the vent pipe 24 and vent valve 25, and into the surrounding atmosphere. This process is continued until the interior of the chamber 16 is at a low enough temperature for the chamber 16 to begin charging with liquid nitrogen. Once the chamber 16 has been fully charged with liquid nitrogen, the inlet valve 23 and vent valve 25 are closed, and the housing 35 is fastened to the outer wall 14 of the container 10. When the inlet valve 23 and vent valve 25 are closed, the pressure-release valve 27 ensures that the pressure within the chamber 16 is maintained at an acceptable level, as discussed below.

The floatation device is then carefully lowered into the sea and allowed to descend down towards the load to be lifted (not shown in the Figures) on the seabed. Weights may be attached to the stand 18 of the container 10 to aid descent, if necessary. While the container 10 is descending towards the load, a certain amount of liquid nitrogen within the container 10 will vaporise to form nitrogen gas. Due to the construction of the container 10, the liquid nitrogen within the cooling pipe 26 will tend to vaporise to form nitrogen gas rather than the liquid nitrogen within the chamber 16. This vaporisation cools the cooling pipe 26 and therefore helps to keep the liquid nitrogen within the chamber 16 cool. The nitrogen gas formed in the cooling pipe 26 will escape through the pressure-release valve 27 into the outlet pipe 30, and hence the lift unit 40, when the pressure within the cooling pipe 26 is approximately 100 millibars higher than the pressure within the lift unit 40.

Figure 2:
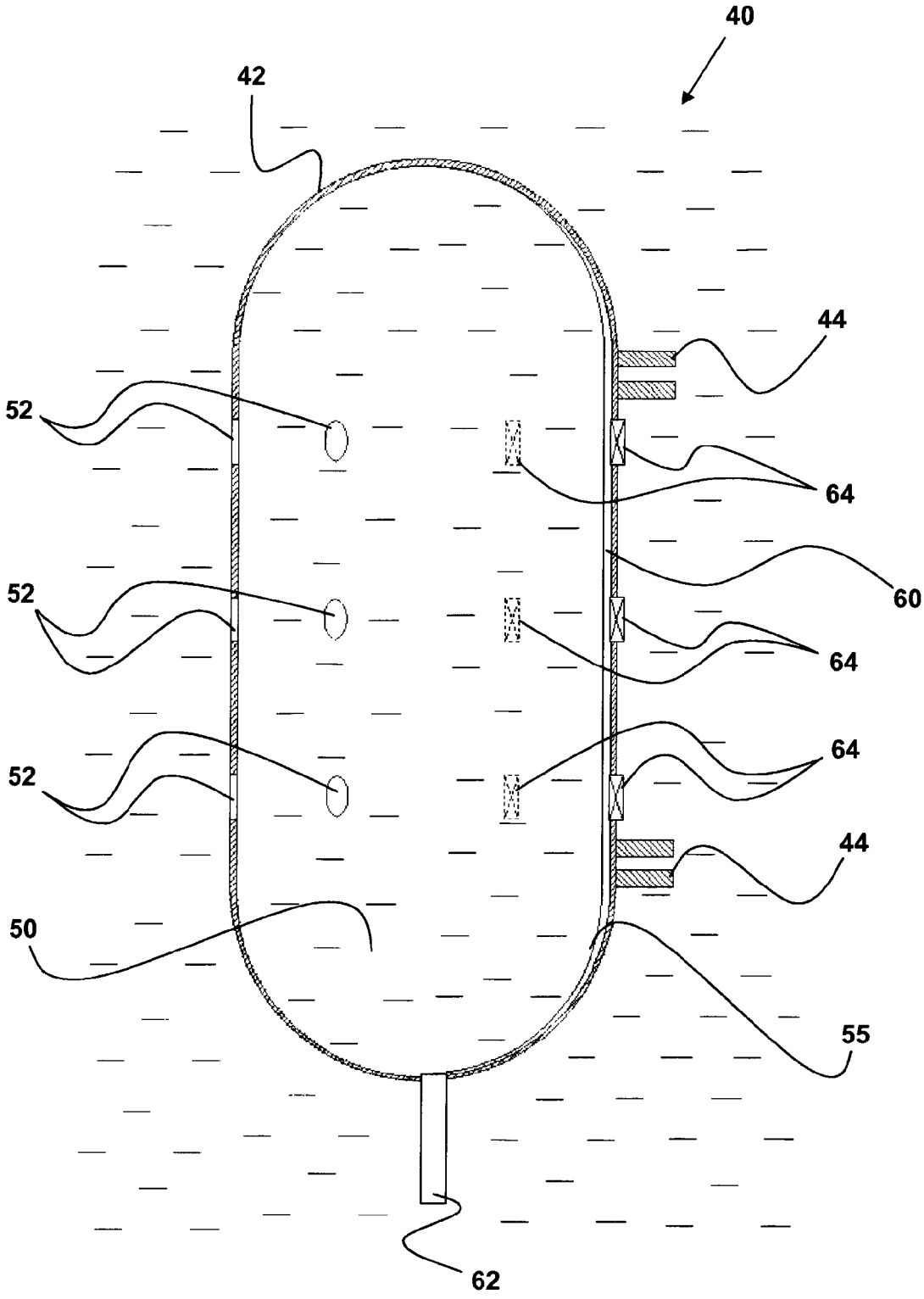
FIG. 2 is a schematic cross-sectional view, showing hidden detail, of a lift unit forming part of the first embodiment when descending towards the seabed.

On descent, the lift unit 40 has a configuration as shown in FIG. 2 where the diaphragm 55 lies alongside an interior surface of the shell 42 such that the sea water chamber 50 almost completely fills the interior volume of the shell 42. In order to prevent the lift unit 40 from becoming charged with nitrogen gas on descent, the vents 64 are maintained in an open state.

When the floatation device reaches the seabed and the load to be lifted, the load is secured to the attachment means 44 of the lift unit 40 by high strength steel cables, for example. The action of attaching the floatation device to the load is typically performed by a robot (not shown in the Figures) which is controlled by a user at the surface.

Figure 3:
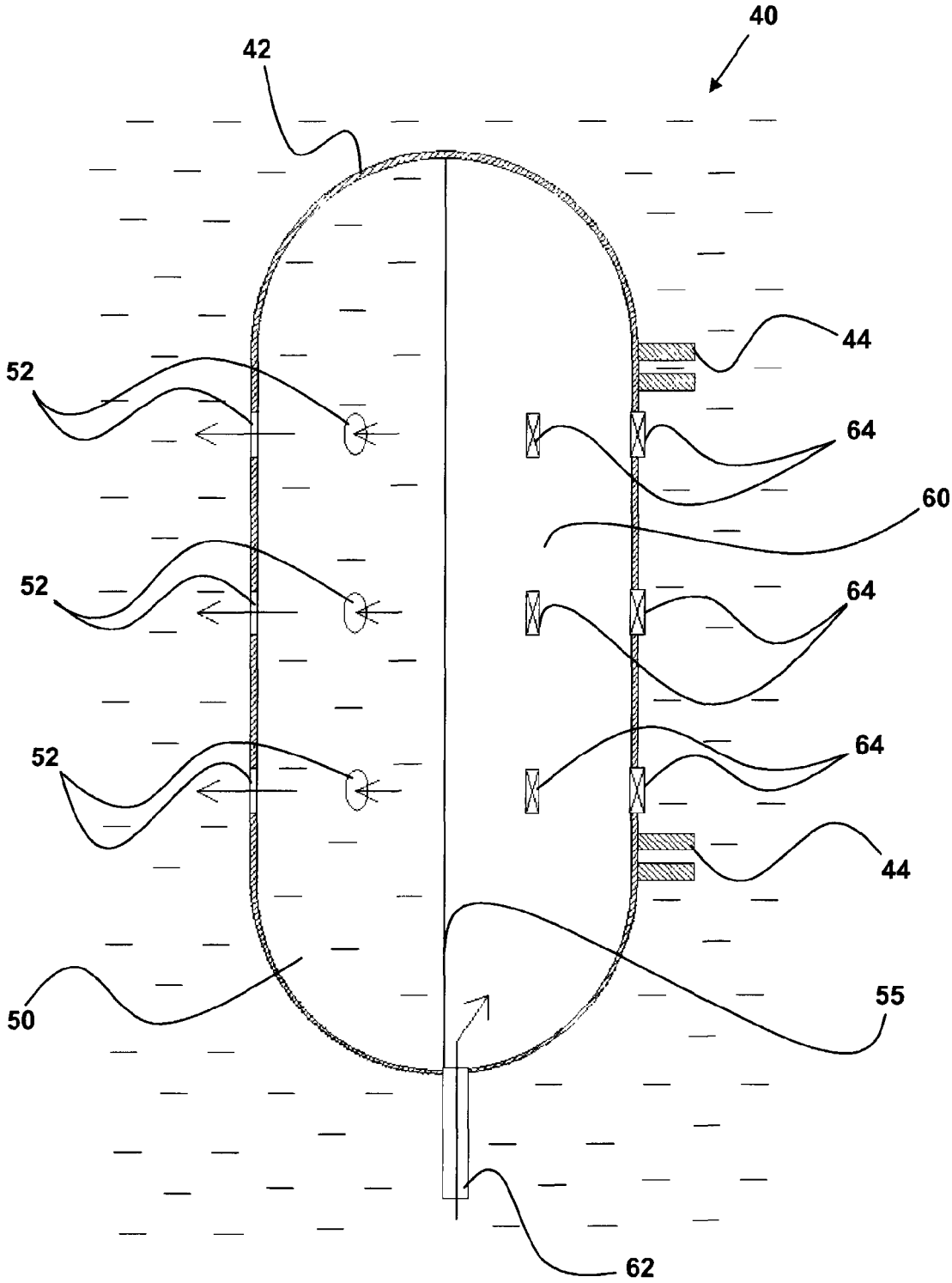
FIG. 3 is a schematic cross-sectional view of the lift unit of the first embodiment when the lift unit is being charged with gas.

The floatation device is then actuated by transmitting signals to the outlet valve 29 and vents 64 so that the outlet valve 29 is set to its open state, whereby liquid nitrogen in the chamber 16 is allowed to flow into the heating pipe 28, and the vents 64 are closed. Once the floatation device has been actuated, liquid nitrogen will flow upwards through the heating pipe 28 and will be heated until nitrogen gas is produced within the heating pipe 28. This nitrogen gas will flow into the gas chamber 60 of the lift unit 40, thereby inflating the gas chamber 60 so that the diaphragm 55 urges sea water out of the apertures 52, as shown in FIG. 3.

Figure 4:
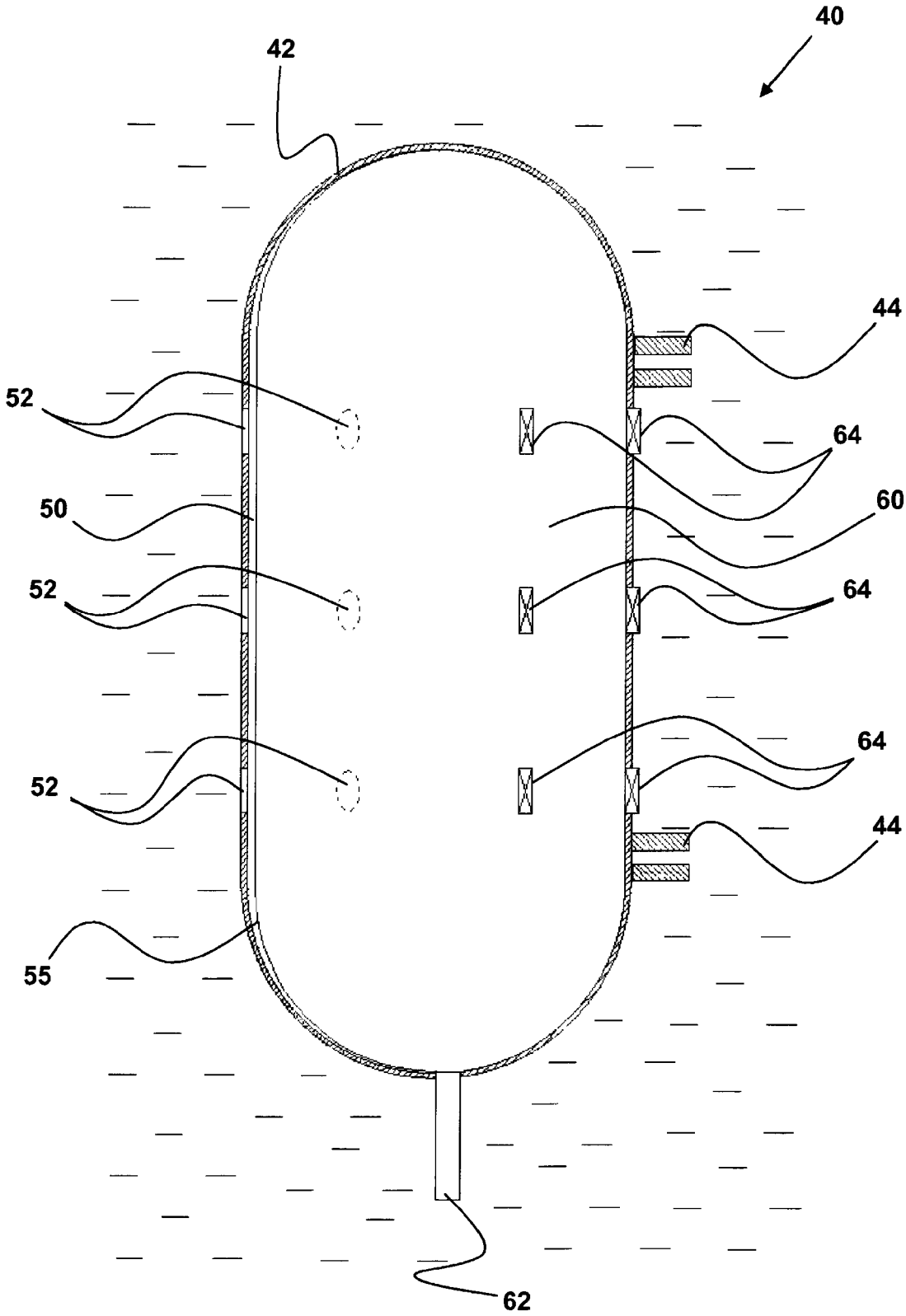
FIG. 4 is a schematic cross-sectional view, showing hidden detail, of the lift unit of the first embodiment when the lift unit is fully charged with gas.
Figure 5:
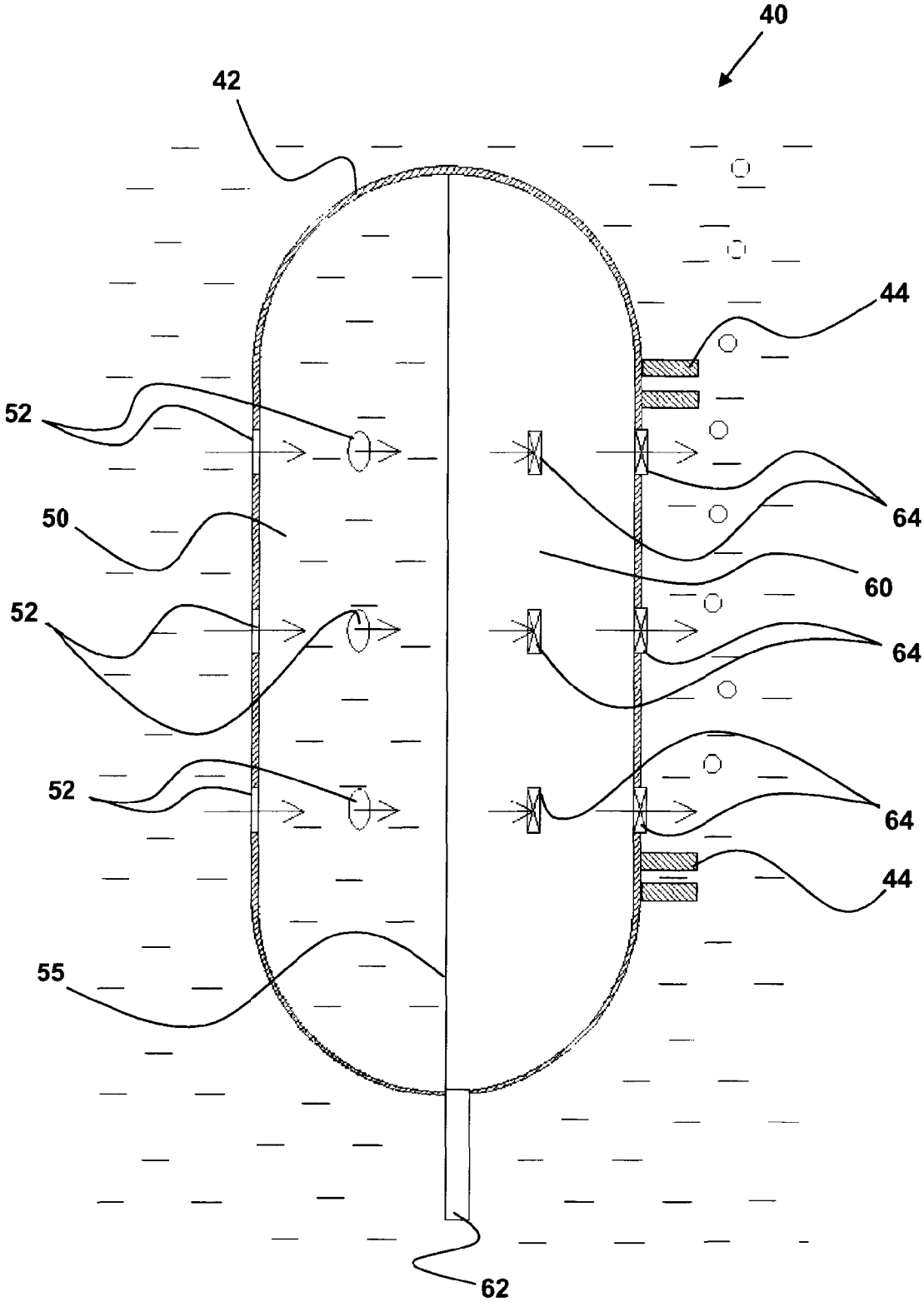
FIG. 5 is a schematic cross-sectional view of the lift unit of the first embodiment when ascending towards the surface of the sea.

Once the chamber 60 of the lift unit 40 is sufficiently charged with nitrogen gas, as shown in FIG. 4, the floatation device and load will begin to ascend due to the increased buoyancy force acting on the lift unit 40. In order to control ascent of the floatation device and load, the vents 64 may be opened to allow nitrogen gas to exit the gas chamber 60, and sea water to enter the sea water chamber 50, thereby reducing the upwards buoyancy force, as shown in FIG. 5. As the floatation device and load ascend towards the surface, the pressure of the sea water will decrease. The pressure-release mechanism of the vents 64 will therefore allow nitrogen gas to exit the gas chamber 60 as the lift unit 40 ascends. Once the floatation device and load reach the surface, they are recovered and the floatation device is detached from the load. The floatation device may then be recharged with liquid nitrogen and reused.

The valves 23,25,27,29, the heat conductors 32 and vents 64 are all electrically powered devices. The power supply may be a battery that is contained within a watertight and pressure-resistant compartment of the container 10, such as the housing 35, or the lift unit 40. Alternatively, the power supply may be situated at the surface and connected by an umbilical cable (not shown in the Figures) to the floatation device. These devices 23, 25, 27, 29, 32, 64 are also actuated by electrical signals. Where the floatation device includes a cable connection to the surface, the electrical signals may be passed down this cable. Otherwise, the electrical signals may be sent as electromagnetic waves from the surface, or may be initiated by ultrasonic signals sent from the surface to the floatation device.

A second embodiment of a floatation device according to the invention is shown in FIGS. 6 to 9. The second embodiment comprises a container 100, shown in FIGS. 6 and 7, a lift bag 120, shown in FIG. 8, and a support frame 130, shown in FIG. 9.

Figure 6:
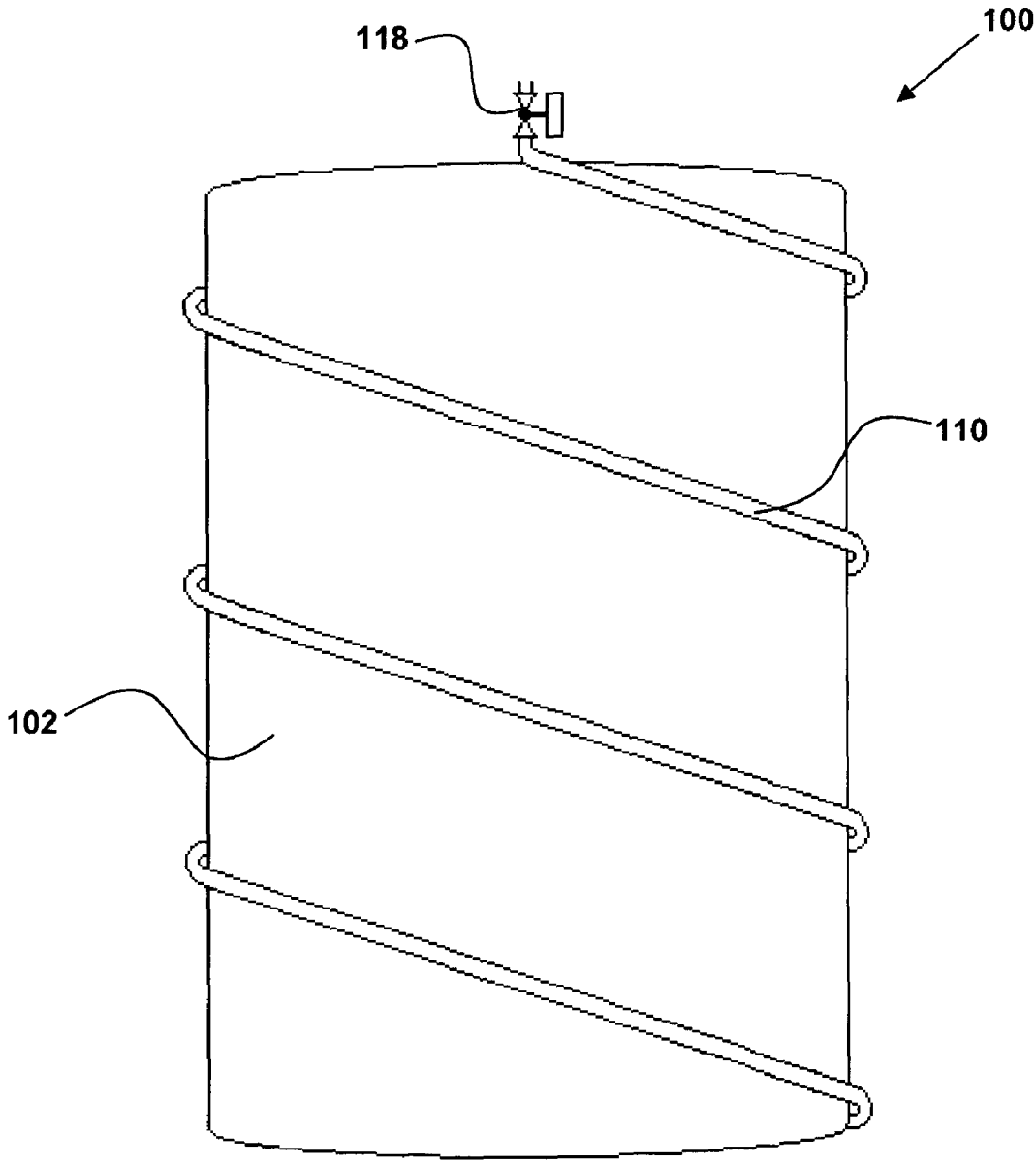
FIG. 6 is a schematic view of a container forming part of a second embodiment of a floatation device according to the invention.
Figure 7:
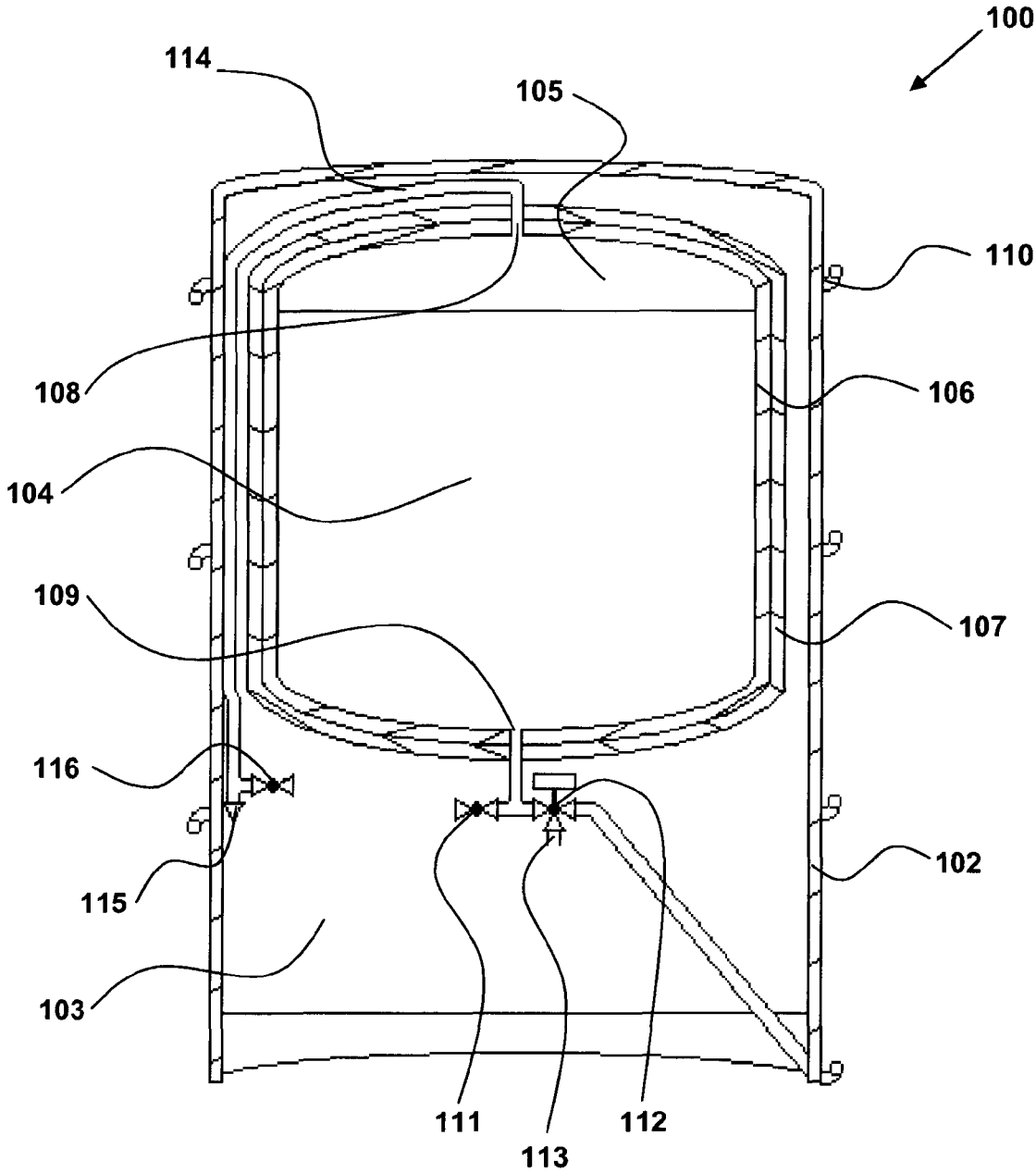
FIG. 7 is a schematic cross-sectional view of the container of the second embodiment.

Referring to FIGS. 6 and 7, the container 100 comprises a housing 102, a chamber 106, a heating pipe 110 and a vent pipe 114. The housing 102 is generally cylindrical in form with a closed upper end that is slightly domed in shape and an open lower end.

The chamber 106 is mounted within the housing 102 adjacent the closed upper end thereof so that there is a substantially empty volume at the lower end of the housing 102. The chamber 106 is generally cylindrical in shape with upper and lower walls of domed shape, as shown in FIG. 7. The upper and lower walls of the chamber 106 each have a centrally positioned port, an upper port 108 and lower port 109 respectively, which are both in fluid communication with the interior of the chamber 106. The external surface of the chamber 106 is covered by a layer of insulating material 107. This layer of insulating material 107 may comprise a mesh bag, which surrounds the chamber 106, and loose insulation material located within the volume between the mesh bag and the external surface of the chamber 106. The upper and lower ports 108,109 extend outwardly from the chamber 106 to a position beyond the insulating layer 107.

The vent pipe 114 extends from the upper port 108 of the chamber 106, downwards along the length of the external surface of the chamber 106, to a position beyond (i.e. below, as shown in FIG. 7) the lower wall of the chamber 106. The end of the vent pipe 114 that is below the lower wall of the chamber 106 terminates in a pressure release valve 115. In addition, immediately before the pressure release valve 115, the vent pipe 114 includes a perpendicularly extending branch pipe that terminates in an outlet valve 116.

The lower port 109 terminates in a T-junction from which extends an inlet pipe with an inlet valve 111 and an outlet pipe connected to a first port of a remotely operable three-way outlet valve 112. The three-way outlet valve 112 also includes a second port connected to a relief nozzle 113 and a third port connected to the heating pipe 110. The three-way outlet valve 112 is remotely switchable between a closed state, in which fluid communication between the three ports is prevented, a relief state, in which only the relief nozzle 113 is in fluid communication with the heating pipe 110, and an active state, in which only the outlet pipe, and hence the lower port 109, is in fluid communication with the heating pipe 110.

The heating pipe 110 extends from the three-way outlet valve 112, through the open lower end of the housing 102, and upwards about the outer surface of the housing 102 in a helical fashion, as shown in FIG. 6. The heating pipe 110 terminates at the centre of the upper surface of the housing 102, where it is connected to a remotely operable supply valve 118.

Figure 8:
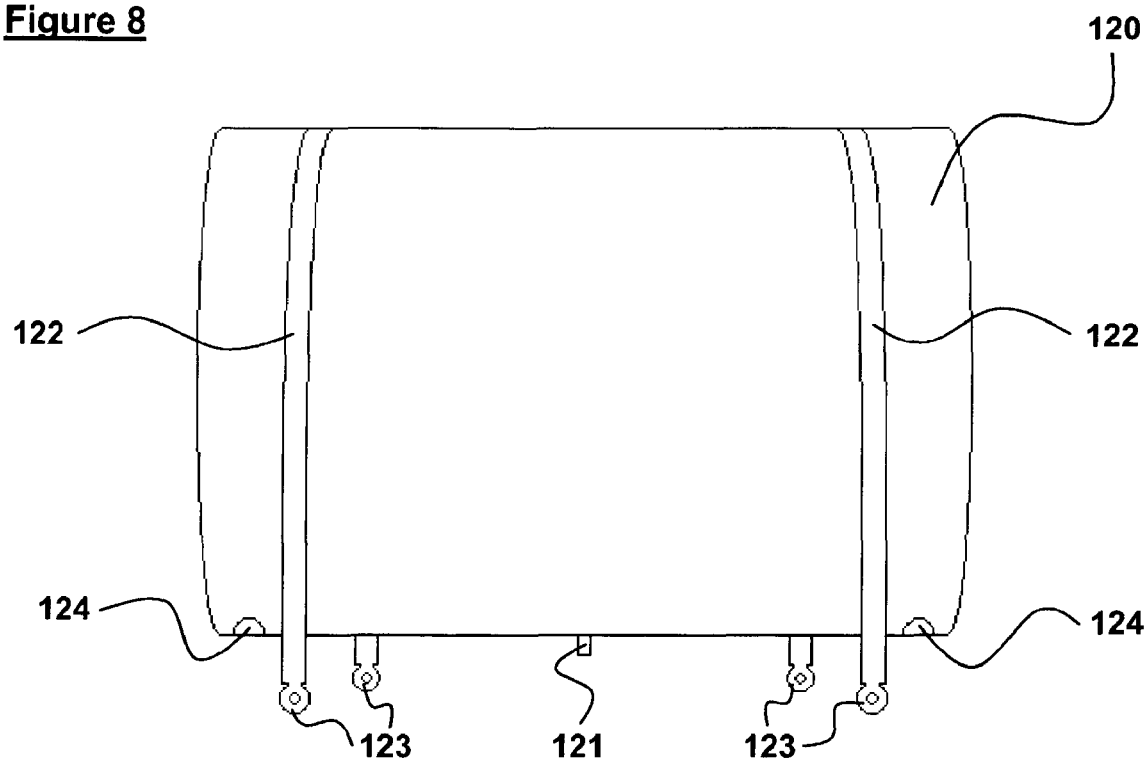
FIG. 8 is a front view of a lift bag, which is shown in its inflated form, forming part of the second embodiment.

FIG. 8 shows the lift bag 120 that is connected to the container 100 by a port 121 which is connected to the supply valve 118. The lift bag 120 is cylindrical in shape and is formed in a flexible material so that the lift bag 120 may be inflated and deflated, in use, between a folded state (not shown in the Figures) and an inflated state (as shown in FIG. 8). The lift bag 120 further includes pressure release vents 124 that release gas from within the lift bag 120 when the interior pressure becomes too great.

The supply valve 118 is switchable so as to either allow or prevent fluid communication between the heating pipe 110 and the interior of the lift bag 120 via port 121. The lift bag 120 is orientated horizontally and a pair of lift straps 123 overlies the curved upper surface of the lift bag 120 and hang vertically down either side of the lift bag 120 as shown in FIG. 8. The lift straps 122 have connection rings 123 at each end thereof which allow connection of the straps 122, and hence the lift bag 120, to the support frame 130 shown in FIG. 9.

Figure 9:
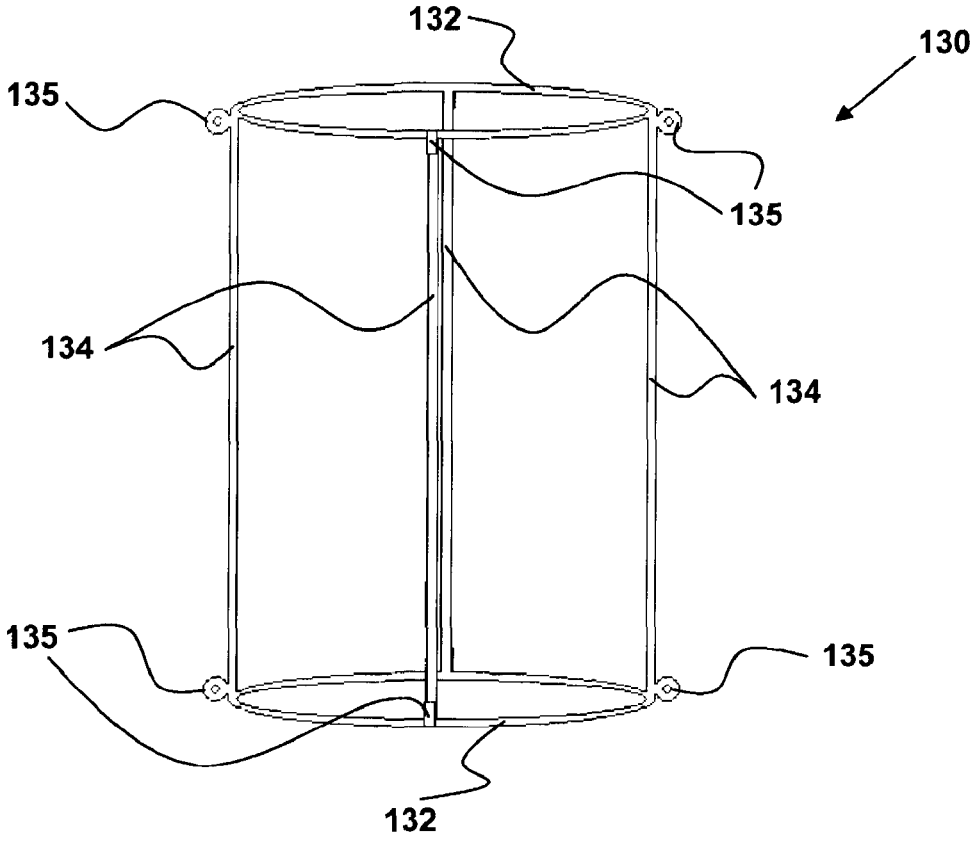
FIG. 9 is a perspective view of a support cage forming part of the second embodiment.

The container 100 is mounted, in use, within the support frame 130 shown in FIG. 9. The support frame 130 comprises a pair of similarly orientated upper and lower rings 132 that are connected together by four struts 134 that extend perpendicularly between the upper and lower rings 132. Each strut 134 includes an outwardly extending connection ring 135 at each end thereof. The support frame 130 is formed in a high strength material, typically a metal, such as steel.

The four connection rings 135 located at the periphery of the upper ring 132 are connected, in use, to the connection rings 123 of the straps 122 of the lift bag 120. The four connection rings 135 located at the periphery of the lower ring 132 are connected, in use, to the load that is to be lifted.

In order to use the second embodiment of the floatation device, the chamber 106 must firstly be charged with liquid nitrogen 104. Again, this process is usually carried out while the floatation device is aboard a ship or the like. Firstly, the user ensures that inlet valve 111 and outlet valve 116 are in an open state, and three-way valve 112 and supply valve 118 are in a closed state. A supply of liquid nitrogen 104 is then connected to inlet valve 111 so that liquid nitrogen 104 enters the interior of the chamber 106 through the lower port 109. Since the interior of the chamber 106 is at a relatively higher temperature than the liquid nitrogen 104, nitrogen gas will be produced which will pass through the upper port 108, through the vent pipe 114, through the outlet valve 116, and into the interior of the housing 102. This process is continued until the interior of the chamber 106 is at a low enough temperature for the chamber 106 to become fully charged with liquid nitrogen 104, at which point the user closes inlet valve 111 and outlet valve 116. The three-way valve 112 is then set to its relief state whereby gas 103 within the housing 102 is allowed to enter the heating pipe 110 but the chamber 106 remains sealed.

The floatation device comprising the container 100, which is fully charged with liquid nitrogen 104, the lift bag 120, which is in a deflated state, and the support frame 130, which encases the container 100, is then lowered into the sea. The floatation device is lowered into the sea in a vertical orientation with the open lower end of the housing 102 being submerged first. In this way a pocket of gas 103 is formed within the housing 102. The user then causes the floatation device to descend, by attaching weights or otherwise, towards a load on the seabed.

As the floatation device descends, the pressure of the surrounding sea water will increase, as explained above. At the same time, nitrogen gas will be produced within the chamber 106 due to the ingress of heat from the surrounding sea water, thereby forming a pocket of nitrogen gas 105 at the upper end of the chamber 106. The pressure of this nitrogen gas 105 will be allowed to increase only as high as a threshold pressure which is slightly higher, eg 100 millibars higher, than the pressure of the surrounding sea water by the pressure release valve 115. Therefore, as nitrogen gas 105 is produced within the chamber 106 and the pressure of this gas 105 increases, nitrogen gas 105 will be vented through vent pipe 114, and pressure release valve 115, into the pocket of gas 103 within the housing 102. The pressure of the pocket of gas 103 and the gas within heating coil 110 will therefore be maintained equal to that of the surrounding sea water, and the nitrogen gas 105 within the chamber 106 will be maintained at a pressure approximately 100 millibars higher than the pressure of the surrounding sea water.

Once the floatation device has reached the load on the seabed, the load is secured to the four connection rings 135 located at the periphery of the lower ring 132 of the support frame 130 by high strength steel cables, for example. The action of attaching the floatation device to the load is typically performed by a robot (not shown in the Figures) which is controlled by a user at the surface.

The floatation device is then actuated by transmitting signals to the remotely operable three-way valve 112 and supply valve 118 so that the three-way valve is set to its active state, whereby liquid nitrogen 104 in the chamber 106 is allowed to flow into the heating pipe 110, and the supply valve 118 is opened, whereby fluid in the heating pipe 110 is allowed to enter the interior of the lift bag 120.

Once the floatation device has been actuated, liquid nitrogen 104 will flow upwards through the heating pipe 110 and will be heated until nitrogen gas is produced within the heating pipe 110. This nitrogen gas will flow through the supply valve 118 and port 121 into the interior of the lift bag 120, thereby inflating the lift bag 120.

Once the lift bag 120 is sufficiently charged with nitrogen gas, the floatation device and load will begin to ascend due to the increased buoyancy force acting on the lift bag 120. As the floatation device and load ascend towards the surface, the pressure of the sea water will decrease. This will cause nitrogen gas to exit the lift bag 120 through the vents 124 during ascent. Once the floatation device and load reach the surface, they are recovered and the floatation device is detached from the load. The floatation device may then be recharged with liquid nitrogen and reused.

Figure 10:
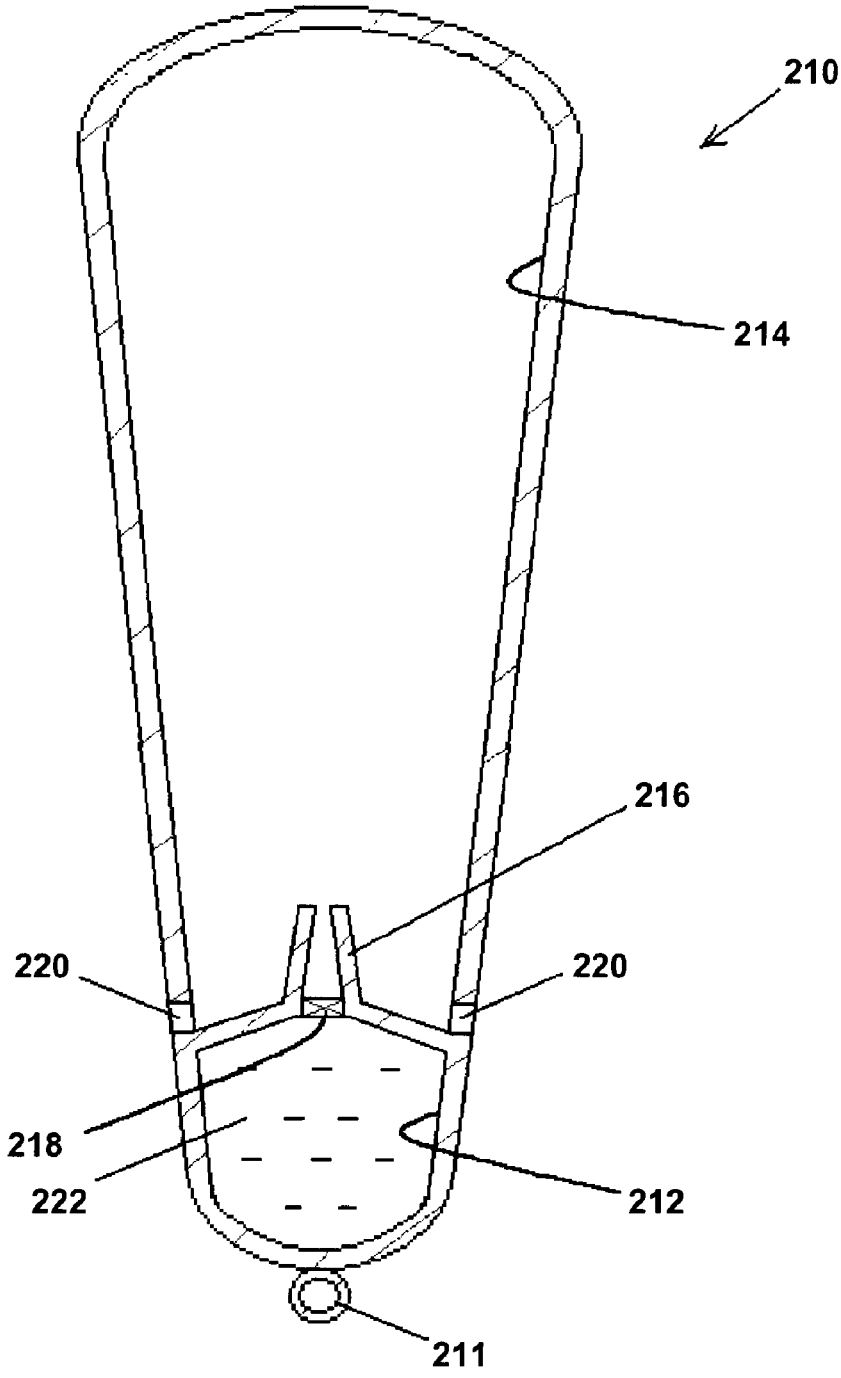
FIG. 10 is a cross-sectional view of a third embodiment of a floatation device according to the invention.

FIGS. 10 to 13 show a third embodiment of a floatation device according to the invention which is generally designated 210. The device 210 has the general shape of an inverted cone having a domed upper end and a smaller domed lower end (as shown in FIG. 10). The diameter of the device 210 therefore increases steadily from the lower end to the upper end thereof. The lower end of the device 210 includes a securing ring 211 that is used to secure the device 210 to the load 226 that is to be raised.

The device 210 comprises a heat-insulated lower chamber 212 and an upper chamber 214 that extends vertically upwards from the upper wall of the lower chamber 212. The device 210 is formed in stainless steel with the lower chamber 212 being heat-insulated by conventional means. The upper chamber 214 is significantly greater in height than the lower chamber 212 and is not heat insulated. The volume ratio between the upper chamber and the lower chamber is approximately equal to the volume ratio between nitrogen gas at a temperature of 0 C and liquid nitrogen at a temperature in the region of −196 C.

The upper wall of the lower chamber 212 is angled slightly upwards from its periphery to an opening at its apex. This opening is sealed by a remote operation valve 218 which either allows or prevents the passage of gas through the opening. A funnel 216 extends upwardly from the valve 218 and opening and opens into the upper chamber 214. The lower chamber 212 is therefore in fluid communication with the upper chamber 214 when the valve 218 is in an open position, and sealed when the valve 218 is in a closed position.

The lower part of the side wall of the upper chamber 214 includes a number of openings 220 which are regularly spaced around the circumference of the upper chamber 214. These openings 220 are located below the upper end of the funnel 216 and above the periphery of the upper wall of the lower chamber 212.

The lower chamber 212 also includes a replaceable cap (not shown in the Figures) that allows the lower chamber 212 to be unsealed, filled with liquid nitrogen 222 and then sealed again ready for use.

In use, the lower chamber 212 is firstly charged with a quantity of liquid nitrogen 222 and then sealed with the cap. The valve 218 is set to the closed position.

The device 210 is then held within the sea, in a horizontal orientation for example, so that the upper chamber 214 charges with sea water 224. Once the upper chamber 214 is sufficiently charged with sea water 224, the device 210 is released and allowed to descend towards an item 226 on the seabed 228, as shown in FIG. 11.

As the device 210 descends, the pressure of the sea water 224 will increase.

Figure 11:
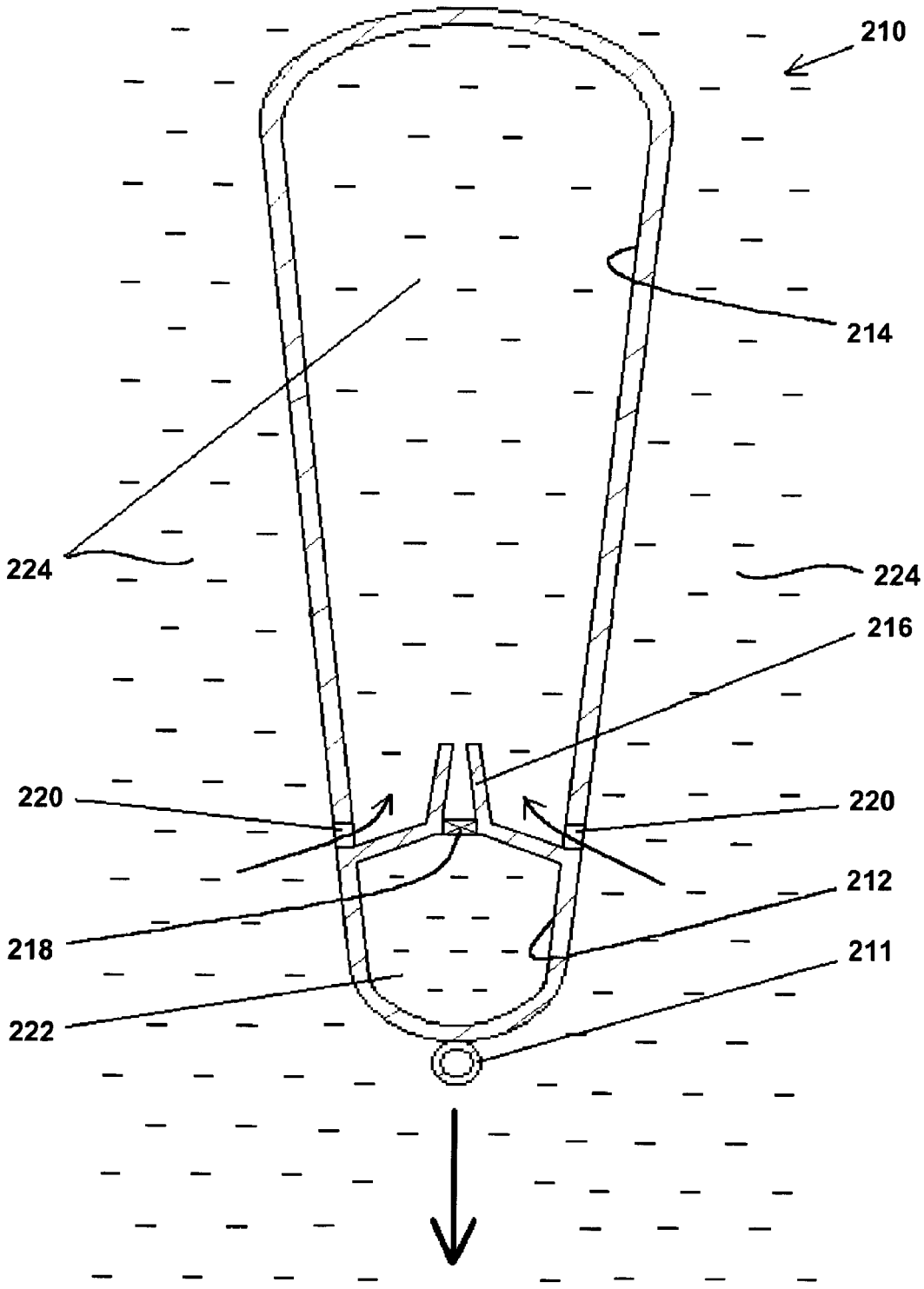
FIG. 11 is a cross-sectional view of the third embodiment during decent towards the seabed.

Sea water 224 will therefore enter the device through the openings 220 as the device 210 descends, as shown by the curved arrows in FIG. 11. Once the device 210 reaches the seabed 228, the pressure of the sea water 224 will be great. If the seabed is at a depth of 300 m, for example, the pressure of the sea water 224 will be approximately 3 MPa, or 30 atmospheres.

Figure 12:
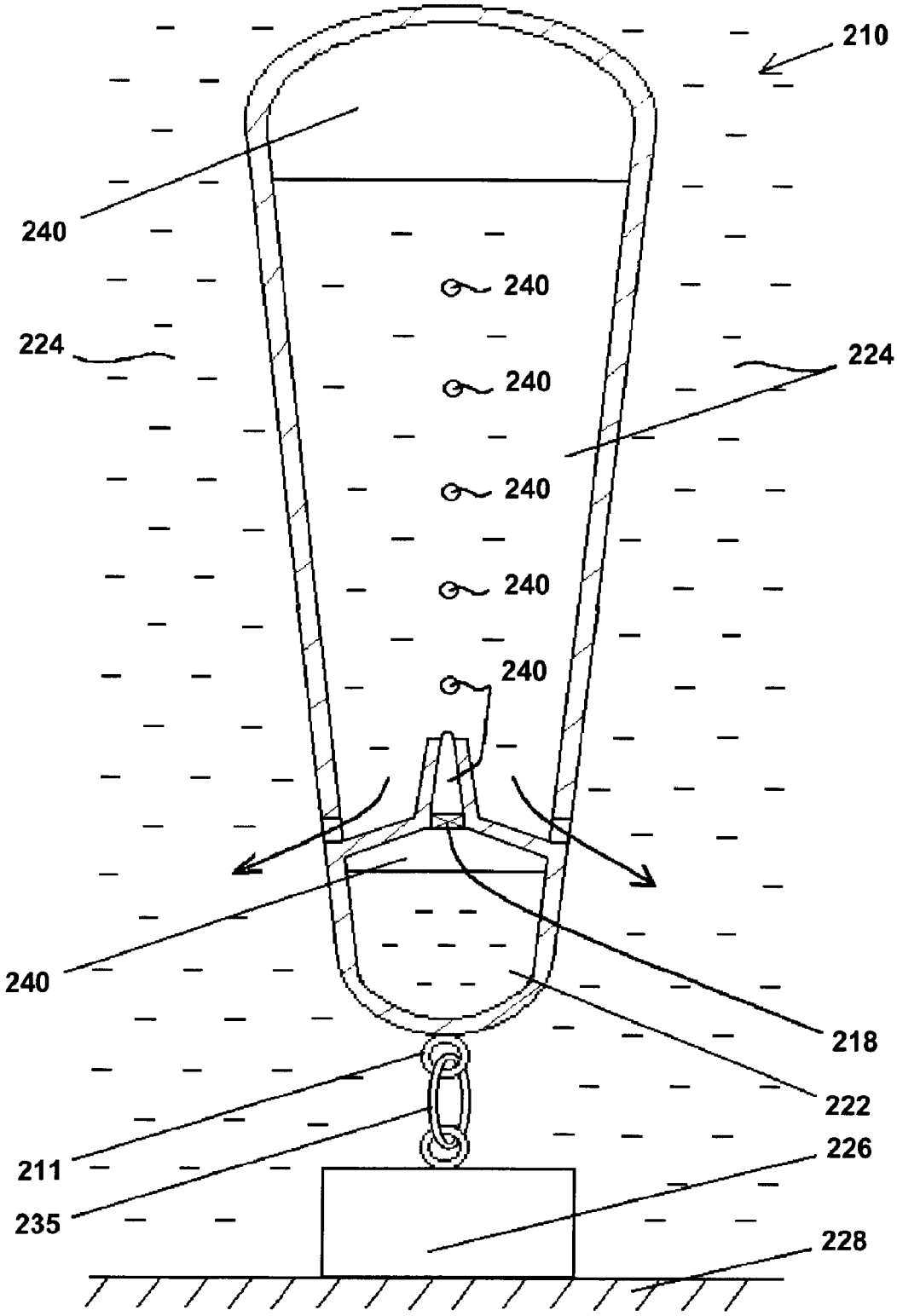
FIG. 12 is a view, partly in section, of the third embodiment attached to a load on the seabed whilst the device is being charged with gas.

Turning now to FIG. 12, once the device 210 has reached the seabed 228, the securing ring 211 of the device is attached to the load 226 by a high strength steel cable 235. The action of attaching the device 210 to the load 226 is performed by a robot (not shown in the Figures) which is controlled by a user at the surface.

Once the device 210 is secured to the load 226, the liquid nitrogen 222 is allowed to heat up and become nitrogen gas 240. The remote operation valve 218 is then switched to the open position and the nitrogen gas 240 is allowed to exit the lower chamber 212 and collect in the upper part of the upper chamber 214. If the device 210 is lying on the seabed 228, the gas 240 will still collect in the upper part of the upper chamber 214 due to the shape of the device 210. When a sufficient volume of gas 240 has collected in the upper chamber 214, the device 210 will orientate itself into an upright position, as shown in FIG. 12. The nitrogen gas 240 collecting at the upper end of the upper chamber 214 forces sea water 224 to exit the upper chamber 214 through the openings 220, as shown by the arrows in FIG. 12.

Figure 13:
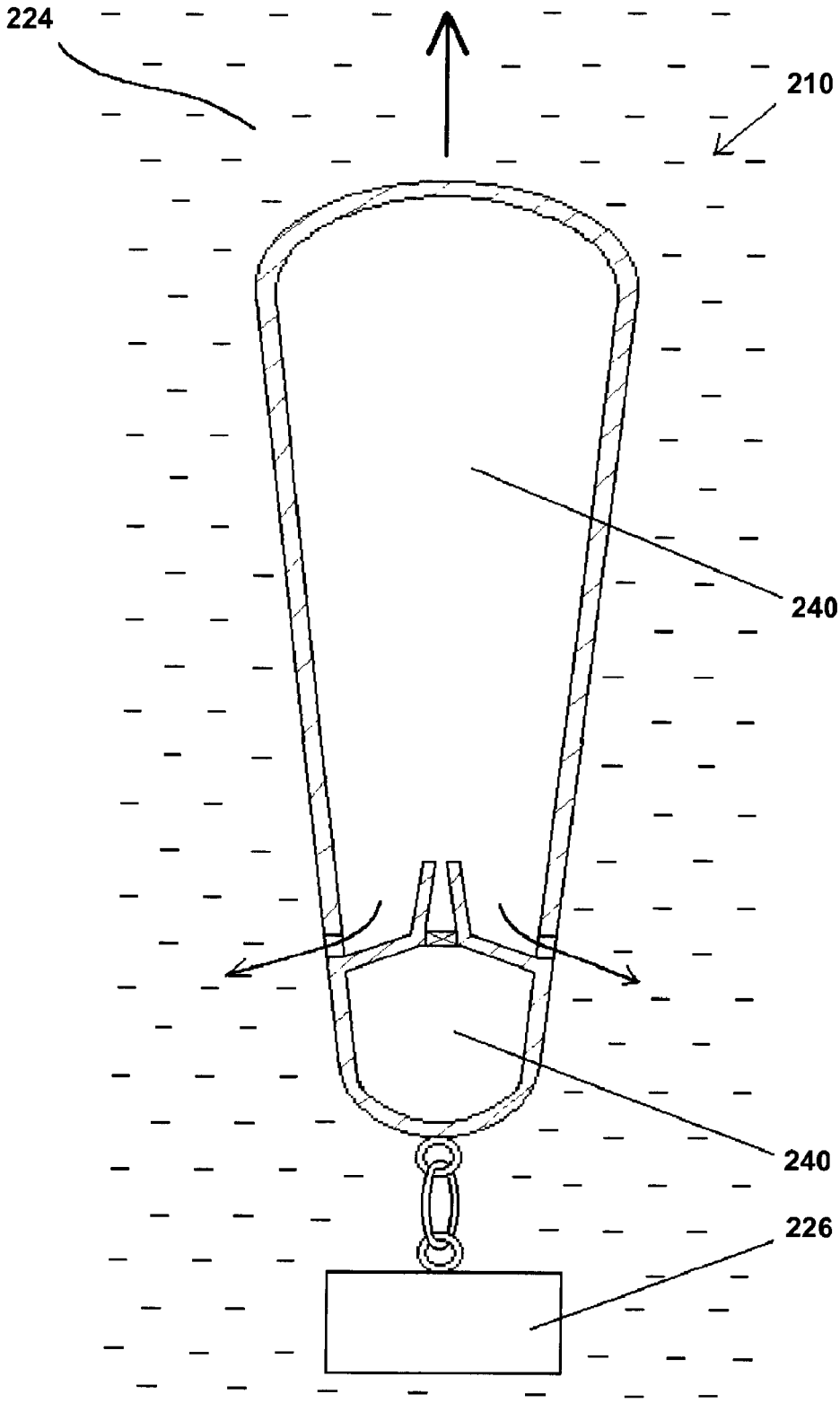
FIG. 13 is a view, partly in section, of the third embodiment and the load during ascent towards the surface of the sea.

When the upper chamber 214 is sufficiently charged with nitrogen gas 240, the device 210 and load 226 will begin to ascend due to the increased buoyancy force acting on the device 210, as shown in FIG. 13.

As the device 210 and load 226 ascend towards the surface, the pressure of the sea water 224 will decrease. This will cause nitrogen gas 240 to exit the upper chamber 214 through the openings 220 during ascent, as shown by the curved arrows in FIG. 13. Once the device 210 and load 226 reach the surface, they are recovered and the device 210 is detached from the load 226. The device 210 may then be recharged with liquid nitrogen 222 and reused.

Figure 14:
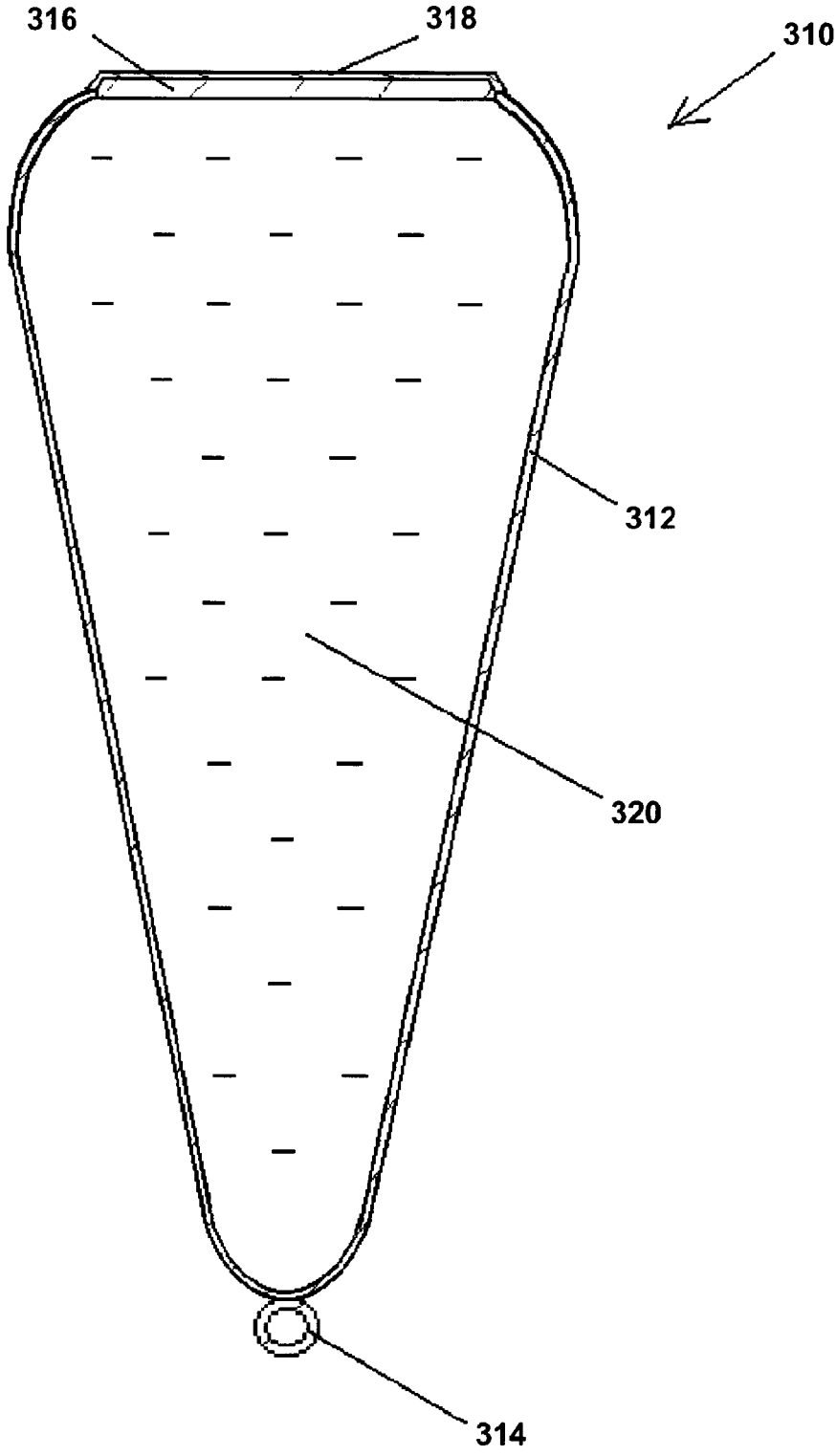
FIG. 14 is a cross-sectional view of a fourth embodiment of a floatation device according to the invention.
Figure 15:
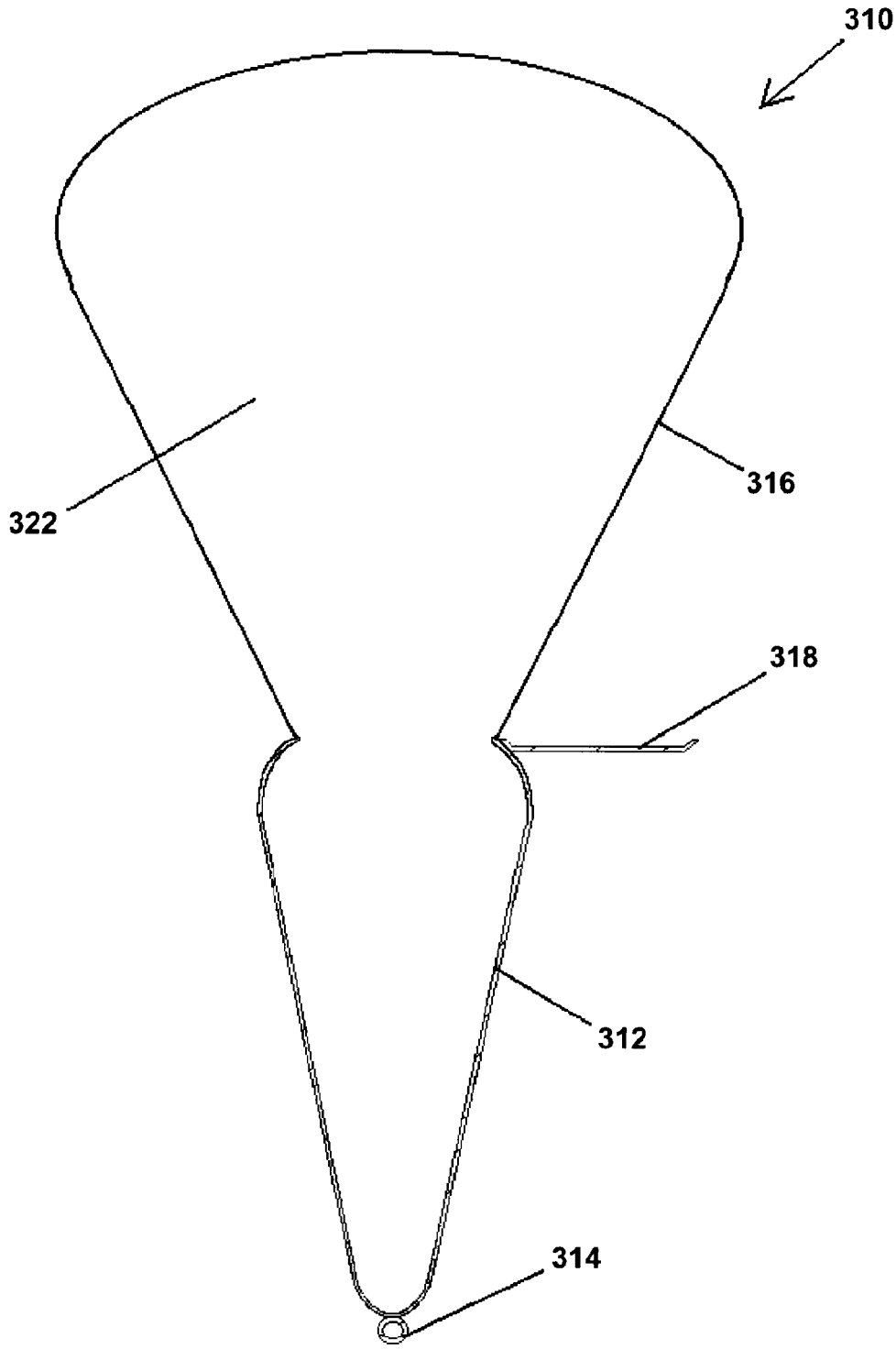
FIG. 15 is a cross-sectional view of the fourth embodiment charged with gas.

A fourth embodiment of a floatation device according to the invention is shown in FIGS. 14 and 15, and is generally designated 310. The device 310 comprises a hollow body 312 that has the general shape of an inverted cone having an upper end with rounded edges and a smaller domed lower end (as shown in FIG. 14).

The body 312 is heat-insulated and is charged with liquid nitrogen 320 in use.

The lower end of the device 310 includes a securing ring 314 that is used to secure the device 310 to the load that is to be raised (not shown in FIGS. 14 and 15).

The upper end of the body 312 has a large opening that has a folded balloon 316 mounted therein. The folded balloon 316 is fixed to the periphery of the opening and held in position by a closure 318 which occludes the opening and seals the body 312. One side of the closure 318 is hingedly mounted to the body 312 at the periphery of the opening, and the opposite side is secured to the body 312 at its opposite side by a remote operation fastening device (not shown in the Figures). The balloon 316 is preferably formed in a conventional coated fabric.

The fourth embodiment of the device 310 is used in a similar manner to the third embodiment 210 save that rather than the remote operation valve 218 being opened to allow the upper chamber 214 to charge with nitrogen gas 222, the remote operation fastening device is released to allow the balloon 316 to charge with nitrogen gas 322. In addition, the balloon 316 includes pressure release vents (not shown in FIGS. 14 and 15) which vent the gas 322 as the device 310 ascends towards the surface.

I claim:

1. A floatation device comprising a container for containing a liquefied gas, a gas chamber and a remotely operable device, and a fluid conduit that connects the interiors of the conduit of the container and the gas chamber;

wherein the remotely operable device is configured to be switchable between a closed state in which fluid communication between the container and the gas chamber is prevented, and an open state in which fluid communication between the container and the gas chamber is enabled and vaporization of the liquefied gas, in use, charges the gas chamber with gas; and wherein the fluid conduit is configured to allow liquefied gas flowing through the fluid conduit to be heated.

2. A floatation device as claimed in claim 1, wherein the container is heat-insulated.

3. A floatation device as claimed in claim 1, wherein the container incorporates a cooling system such as those conventionally used with liquefied gases.

4. A floatation device as claimed in claim 1, wherein the floatation device includes means for aiding heat conduction from the surroundings to the liquefied gas within the container.

5. A floatation device as claimed in claim 1, wherein the fluid conduit is a pipe that is coiled about the external surface of the container.

6. A floatation device as claimed in claim 1, wherein the gas chamber includes at least one pressure release vent that vents the gas, as necessary, during use.

7. A floatation device as claimed in claim 1, wherein the gas chamber is a separate component to the container, and the gas chamber is secured to the container during use.

8. A floatation device as claimed in claim 1, wherein the gas chamber is flexible in form.

9. A floatation device as claimed in claim 1, wherein the floatation device is provided with a buoyancy unit comprising a rigid enclosure defining an interior volume and a flexible diaphragm that partitions the interior volume into first and second chambers, the first chamber defining the gas chamber and having an inlet for connection to a container, and the second chamber having a fluid outlet, wherein the diaphragm is movable on charging of the first chamber with gas so as to urge fluid within the second chamber out of the buoyancy unit through the fluid outlet.

10. A method of raising an item from the seabed, or lowering an item to the seabed, which method comprises the steps of: (a) attaching a floatation device according to claim 1 to the item, and (b) switching the remotely operable device from its closed state to its open state, such that the gas chamber is charged with gas resulting from vaporization of the liquefied gas.

11. A method as claimed in claim 10, wherein the item is raised from the seabed, and the floatation device is attached to the item whilst the item is on the seabed.

12. A method as claimed in claim 11, wherein the floatation device is lowered down to the seabed before it is attached to the item.

13. A method as claimed in claim 11 wherein the floatation device is allowed to descend to the seabed under the influence of gravity before it is attached to the item.

14. A method as claimed in claim 10, wherein the step of attaching the floatation device to the item on the seabed is performed by a remotely operable means.

15. A method as claimed in claim 10, wherein the switching of the remotely operable device from its closed state to its open state is achieved by a user at the surface of the sea transmitting signals to the device.

* * * * *